United States Patent [19]

Khachaturian

[11] Patent Number: 4,714,382

[45] Date of Patent: Dec. 22, 1987

[54] METHOD AND APPARATUS FOR THE OFFSHORE INSTALLATION OF MULTI-TON PREFABRICATED DECK PACKAGES ON PARTIALLY SUBMERGED OFFSHORE JACKET FOUNDATIONS

[76] Inventor: Jon E. Khachaturian, 3829 Birchfield Dr., Harvey, La. 70058

[21] Appl. No.: 734,402

[22] Filed: May 14, 1985

[51] Int. Cl.[4] ..... E02B 17/00

[52] U.S. Cl. ..... 405/204; 405/209

[58] Field of Search ..... 405/196, 203, 204, 209, 405/195; 114/264, 265

[56] References Cited

U.S. PATENT DOCUMENTS

| | | | |
|---|---|---|---|
| 2,598,088 | 5/1952 | Wilson | 405/204 |
| 2,817,212 | 12/1957 | Stubbs | 405/209 |
| 2,959,015 | 11/1960 | Beck | 405/209 |
| 3,054,267 | 9/1962 | Alcorn et al. | 405/209 |
| 4,118,942 | 10/1978 | Liautaud | 405/204 |
| 4,242,011 | 12/1980 | Karsan et al. | 405/204 |
| 4,249,618 | 2/1981 | Lamy | 405/204 X |

*Primary Examiner*—David H. Corbin

*Attorney, Agent, or Firm*—Pravel, Gambrell, Hewitt, Kimball & Krieger

[57] ABSTRACT

A method and apparatus for the installation of large multi-ton prefabricated deck packages includes the use of usually two barges defining a base that can support a large multi-ton load. A variable dimensional truss assembly is supported by the barge and forms a load transfer interface between the barge and the deck package. Upper and lower connections form attachments between the truss members and the deck package at upper and lower elevational positions on the deck package. The variable dimension truss includes at least one member of variable length, in the preferred embodiment being a winch powered cable that can be extended and retracted by winding and unwinding the winch. Alternate embodiments include the use of a hydraulic cylinder as an example.

23 Claims, 11 Drawing Figures

METHOD AND APPARATUS FOR THE OFFSHORE INSTALLATION OF MULTI-TON PREFABRICATED DECK PACKAGES ON PARTIALLY SUBMERGED OFFSHORE JACKET FOUNDATIONS

BACKGROUND OF THE INVENTION

1. Field of the Invention

The present invention relates to the placement of large multi-ton prefabricated deck packages or "rigs" in an offshore environment upon a usually partially submerged jacket that extends between the seabed and the water surface. Even more particularly, the present invention relates to the use of a moving lifting assembly which is preferably barge supported that can place a very large deck package upon an offshore jacket foundation without the use of enormous lifting booms such as form a part of derrick barges, offshore cranes, and the like.

2. General Background

In the offshore oil and gas industry, the search for oil and gas often involves a marine environment. Sometimes the search goes many miles offshore, and drilling takes place into the seabed in many hundreds of feet of water depth. The problem of drilling oil wells offshore and then producing these wells has been solved in part by the use of enormous underwater fixed platform structures with foundations which are mostly submerged, but usually extending a number of feet above the water surface. Upon this foundation (or "jacket" as it is called in the art) there is usually placed a very large prefabricated rig or deck platform. The term "deck platform" as used herein should be understood to include any of a large variety of prefabricated structures which are placed on an offshore jacket foundation to form a fixed offshore platform. Thus, a "deck platform" can include, e.g. a drilling rig, a production platform, a crew quarters, living quarters, or the like. The supporting jacket is usually a very large multi-chord base formed of multiple sections of structural tubing or pipe which are welded together. Such jackets have been used for a number of years for the purpose of supporting large deck platforms in an offshore environment.

The jacket or foundation is usually prefabricated by welding on land in a fabrication yard, preferably beside a navigable waterway. Thus the completed jacket can be placed upon a large transport barge so that it can be moved to the drill site where it will be placed on the ocean floor but extending to the water surface. As an example, an offshore jacket can be several hundred feet in length. The size of the jacket is of course a function of the depth of water in which the rig will be placed. Thus, a five hundred (500) foot water depth at the drill site (or production site) will require a jacket which is approximately 500–550 feet tall. The jacket is usually partially submerged, with a small upper portion of the jacket extending slightly above the water surface. An offshore jacket as described and in its position on the seabed can be seen, for example, in the Blight, et al Pat. No. 4,252,469 entitled "Method and Apparatus for Installing Integrated Deck Structure and Rapidly Separating Same from Supporting Barge Means." Specifically, FIGS. 1, 2, and 3 of the Blight, et al patent show an offshore jacket on the seabed.

A small upper portion of the jacket extends above the water surface. This exposed portion of the jacket is the portion upon which the "deck platform" is placed and supported by. This upper portion of the jacket is usually equipped with a number of alignment devices which enhance the proper placement of the deck package on the jacket. Such alignment devices are referred to variously as stabbing eyes, sockets, or the like. The use of such alignment devices, sockets, or stabbing eyes can be seen in the Blight, et al Pat. Nos. 4,252,468 and 4,252,469 as well as in the the Karsan U.S. Pat. No. 4,242,011. For purposes of background and reference, the Karsan patent 4,242,011 is incorporated herein by reference. The Blight, et al U.S. Pat. Nos. 4,252,469 and 4,252,468 are likewise each incorporated herein by reference.

Deck platforms can be extremely large and have correspondingly heavy weights. For example, it is not uncommon for a deck platform such as a drilling rig, crew quarters, production platform or the like to be between 500 and 5,000 tons gross weight. Such enormous load values present significant problems in the placement of deck platforms on offshore jacket structures. Firstly, the placement is done entirely in a marine environment. While the jacket can be laid on its side and/or floated into position, the quarters itself is not a submersible structure and must be generally supported in an upright condition above the water surface to prevent water damage to the many components which form a part of the drilling or production platform such as electrical systems, wall constructions, and all of the other portions of a typical structure which will be inhabited by individuals and used as oil and gas well drilling or production equipment. The art has typically used enormous derrick barges for the purpose of setting or placing deck packages on jackets in an offshore environment. These derrick barges are large, rectangular barge structures having a high capacity lifting boom mounted at one end portion of the deck of the barge. The barge, for example might be 300–400 feet in length, 50–75 feet in width, and 25–30 feet deep. These figures are exemplary. A derrick barge might have a lifting capacity of for example, 800 tons. For very large structures such as for example, a 1500 ton deck package, two derrick barges can be used, each supporting one side portion of the deck platform with a multi-line lift system supported by an enormous structural boom which extends high into the air above the package during the lift. The boom simply works in the same way as in onshore lifting boom, namely the loadline raises and/or lowers the package into its proper position upon the jacket. While the use of such derrick barges has been very successful in the placing of offshore deck packages on jackets through the years, such derrick barges are generally limited in their capacity to packages of 2,000 tons or less. Further, derrick barges of such an enormous capacity are extremely expensive to manufacture and operate. Many thousands of dollars per hour as a cost of using such a device is not uncommon.

However, when very large loads of, for example 3,000–4,000 tons are involved, the limitation of the derrick barge usually prohibits such a placement on an offshore jacket.

The present invention provides a method and apparatus for the placement of a multi-ton deck package on an offshore jacket. The apparatus includes one or more barges defining a base that supports the large multi-ton load of the deck package. In the preferred embodiment, a horizontally extending truss is mounted on each side of the deck package to be lifted during operation. In the preferred embodiment, two barges are used respectively, each having a preferably variable dimension lift truss on its upper deck surface. The truss preferably includes a member of variable length so that the cross-sectional dimensions of the truss can be varied. The truss forms thus a load transfer between each barge and the deck package to be lifted and placed. Upper and lower connections are formed between the lifting truss and the deck package at respective upper and lower elevational positions. Power is provided, preferably in the form of a winch mounted on the barge for changing the length of the variable length member of the truss so that elevational position of the deck package with respect to the barge can be varied such as during a lowering of the deck package to the jacket foundation. In the method of the present invention, the multi-ton deck package is first transported on a transport barge to the site where it will eventually assist in the drilling oil and/or production of a well. In the preferred embodiment, a lifting assembly is attached to the deck package on generally opposite sides of the deck package and at upper and lower positions. However, it should be understood that the lifting assembly could be attached to the prefabricated deck package prior to transportation to the site. In the latter embodiment, the transport barge and one or more lifting barges could be lashed together and transported to the site by tugs or like tow vessels. One element of the truss-like lifting assembly preferably includes a movable portion which has a variable length. In the preferred embodiment, the movable portion is a winch powered cable which can be extended or retracted between the lift barge and the deck package being lifted. In the preferred embodiment, two lift barges support respectively a pair of truss-like lifting assemblies which in combination with the deck package form an overall truss arrangement. That is, the deck package itself forms a portion of the truss during the lift, and may carry both compression and tension loads. The truss-like lifting assemblies thus support the deck package and elevate it above the surface of the transport barge so that the transport barge can be removed at a support for the deck package. This allows the deck package to be placed vertically above the jacket and aligned with the jacket so that the deck package can be placed upon the jacket by lowering.

The above referenced Blight patents '468 and '469 and the Karsan patent 4,242,011 do relate generally to methods of installing deck structures upon offshore jackets. In Karsan, however, a single transport barge is placed under the deck platform. The deck platform extends laterally and downwardly toward the water line and the upper surface of the jacket, defining a central vessel passageway that is occupied by the transport barge. Unlike the present invention, Karsan does not use truss-like lifting assemblies that are positioned on each side of the deck package being lifted. Further, Karsan doesn't use a truss-like lifting assembly having at least one member of the truss which is of a variable length. With the present invention, this allows a dimensional change in the cross-sectional configuration of the truss with respect to a vertical cross section of the truss thus providing a means of raising and lowering the deck package. These same comments are applicable to the above discussed Blight, et al. patents which also relate to the use of a single transport barge which is placed centrally and under the deck platform to be lifted. Further, Blight, et al. leaves the transport barge in position until the deck platform and jacket have been assembled. This requires in many cases a specially designed jacket and deck platform having a central passageway which will accommodate the vessel under the deck platform and between the peripheral elements of the jacket and the deck platform. This system would not be able to lift the large number of packages which are generally cube shaped and have no central passageway which would accommodate a vessel as described in Blight et al. and Karsan.

An earlier patent, U.S. Pat. No. 2,598,088 issued to H. A. Wilson entitled "Offshore Platform Structure and Method of Erecting Same" discusses the placement of a drilling structure with a barge wherein the legs of the drilling structure are placed while the drilling structure is supported by two barges. The Wilson device does not use truss-like lifting assemblies having variable length portions which are placed generally on opposite sides of the deck package. Rather, Wilson relates to a platform which is floated in place and the support legs are then placed under the floating platform. Thus, in the Wilson reference, an in-place underlying supporting jacket is not contemplated.

The Natvig, et al U.S. Pat. No. 3,977,346 discusses a method of placing a deck structure upon a building site such as a pier. The method includes the pre-assembly of a deck structure upon a base structure on land so that the deck structure extends outwardly over a body of water. Floating barges are provided for supporting the deck structure outwardly of the building site. The deck structure is then transferred to the supportive base structure by means of barges. The Natvig reference uses two barges which are placed on opposite sides of a platform with pedestal type fixed supports forming a load transfer member between the barges and the platform. However, the fixed pedestals of Natvig are unlike the truss-like lifting arrangement of applicant which include movable portions at least one of which can be of a variable length.

BRIEF DESCRIPTION OF THE DRAWINGS

For a further understanding of the nature and objects of the present invention, reference should be had to the following detailed description, taken in conjunction with the accompanying drawings in which the parts are given like reference numerals and wherein.

DETAILED DESCRIPTION OF THE PREFERRED EMBODIMENT

Figure 2:
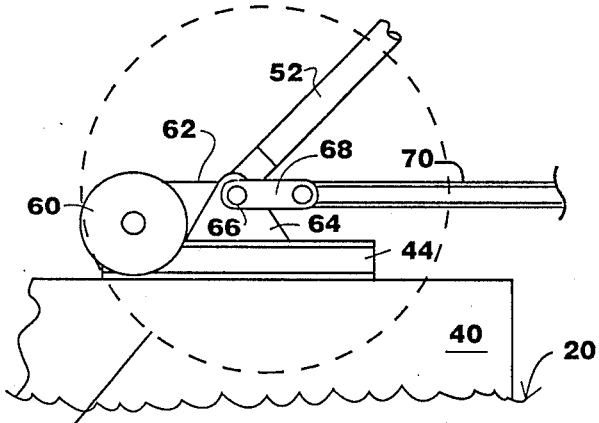
FIG. 2 is a detail fragmentary view of the preferred embodiment of the apparatus of the present invention illustrating the winch and winch cable portions mounted upon the lift barger.

FIGS. 1–7 and 10–11 best illustrate the preferred embodiment of the apparatus of the present invention designated generally by the numeral 10.

In FIGS. 1–2 and 11–12 there can be seen an offshore jacket 12 which is comprised of a number of longitudinally running chord members 14, 16 cross-braced by a number of diagonal members 17. The construction and design of such jackets 12 are well known in the art. The upper portion of jacket 12 includes an exposed structure 22, 24 which is dimensionally receptive of the lowermost portion 26, 28 of deck package 30. Deck package 30 includes multiple horizontal members 32 and multiple vertical members 34 as well as fixed tension carrying member 33 which is positioned in the same horizontal plane as pinned connections 56 as will be described more fully hereinafter. In the drawings, 20 indicates the water surface while 18 indicates the seabed or mudline.

Figure 1:
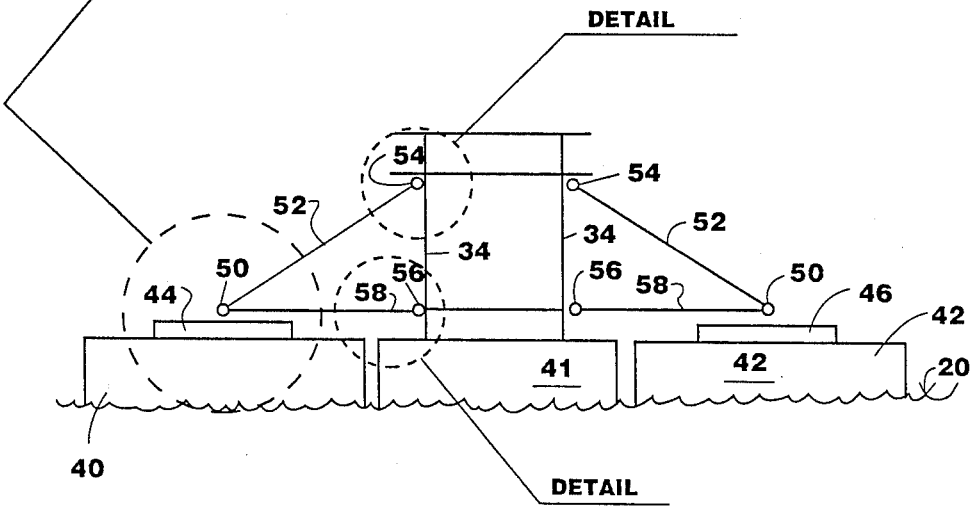
FIG. 1 an end elevational view of the preferred embodiment of the apparatus of the present invention.
Figure 10:
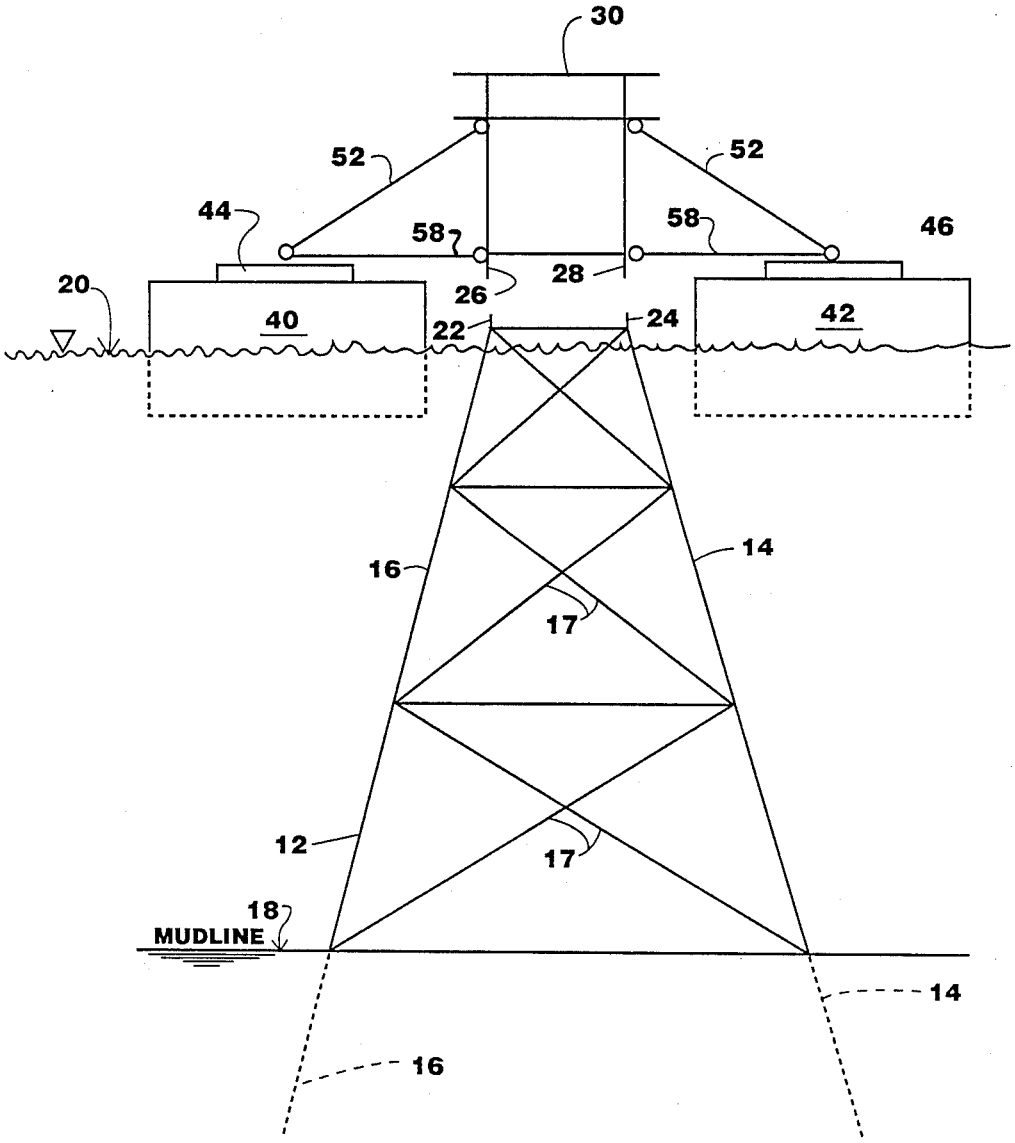
Figure 11:
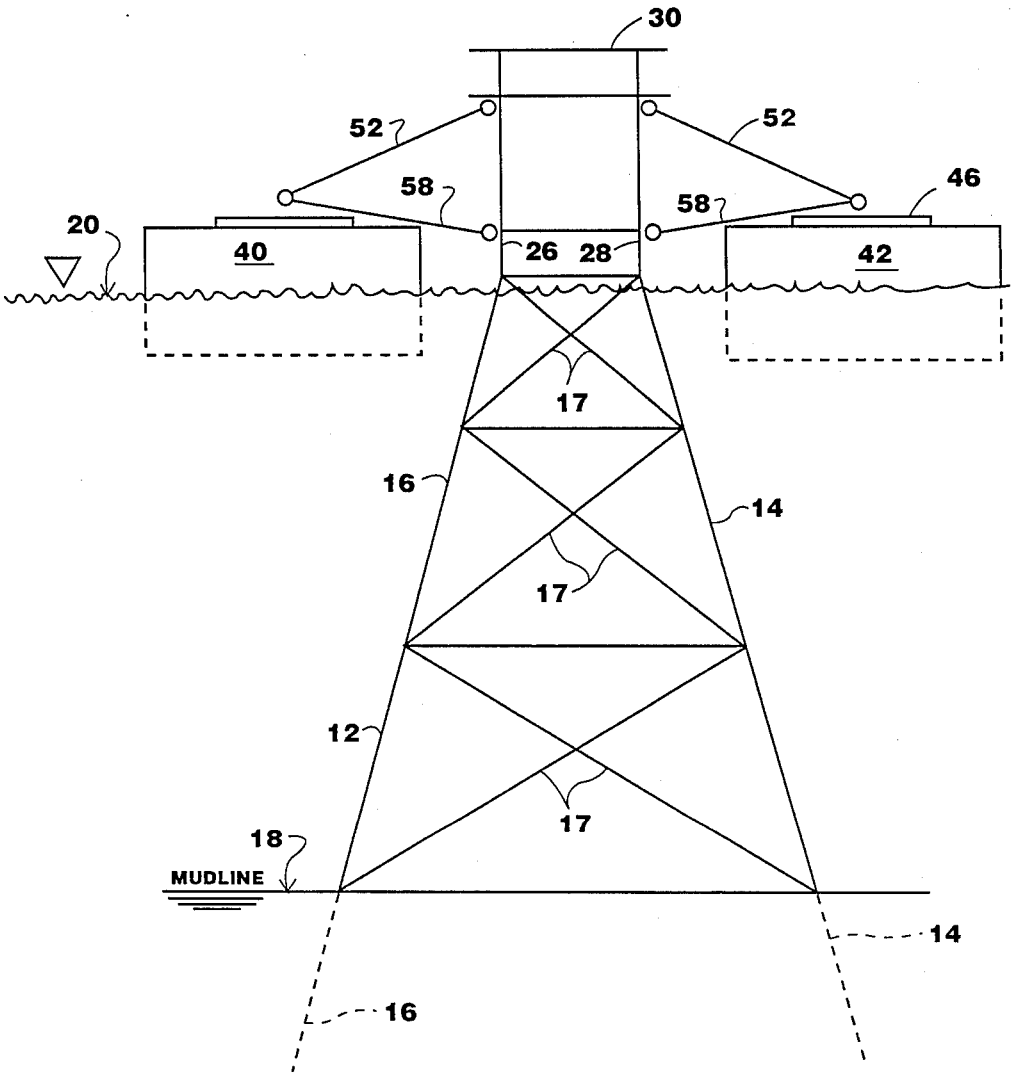

It should be understood that the view of deck package 30 of FIGS. 1 and 10–11 is schematic and illustrative. Such deck packages 30 are enormous multi-ton structures having gross weights of, for example 3,000–4,000 tons. These structures are typically of enormous dimensional size and include a vast number of horizontal and vertical members 32, 33, 34 which can be cross-braced and diagonally braced so that the entire package 30 can be lifted as a prefabricated unit and placed upon jacket 12 with the members 26, 28 aligning with and connecting to the members 22, 24. The members 26, 34 and 28, 34 in FIG. 11 define deck legs of deck package 30.

A pair of spaced apart and preferably separate barges 40, 42 are shown in FIGS. 1 and 11–12. Barges 40, 42 as illustrated are lift barges which support a truss which is defined by compression diagonal truss member 52, variable length truss member 58, deck leg 34, and members 32, 33 of deck package 30. Fixed tension member 33 and horizontal member 32 form portions of an overall truss which includes members 52, 58 associated with barge 40 and members 52, 58 associated with barge 46. Thus, the truss includes upper and lower connections 54, 56 that are placed generally on opposite sides of the deck platform 30. Connections 54 define upper pinned connections while connection 56 defines lower pinned connections to platform 30 preferably in the vicinity of deck legs 34. Barges 40, 42 are preferably floating type barges which have sufficient buoyancy to carry the full load of deck package 30, and of all the truss members 52, 58 as shown in the drawings.

Pinned connections 50 are provided on each barged 40, 42 at base members 44, 46 which act as load spreaders. Bases 44, 46 can be, for example heavily reinforced pedestals provided on each barge 40 at the upper surface or upper deck portion thereof.

FIG. 2 provides a more detailed view of pinned connection 50 as including a padeye assembly 64 to which is attached multi-sheave block assembly 68 with a pin 66 forming the connection between padeye assembly 64 and block assembly 68. Padeye assembly 64 also forms a pinned connection with pins 66 to compression diagonal truss member 52. Winch 60 is a rotary drum type winch having a winch line 62 which eventually forms multiple winds 70 at its ends with the two multi-sheave block assemblies 68.

Figure 3:
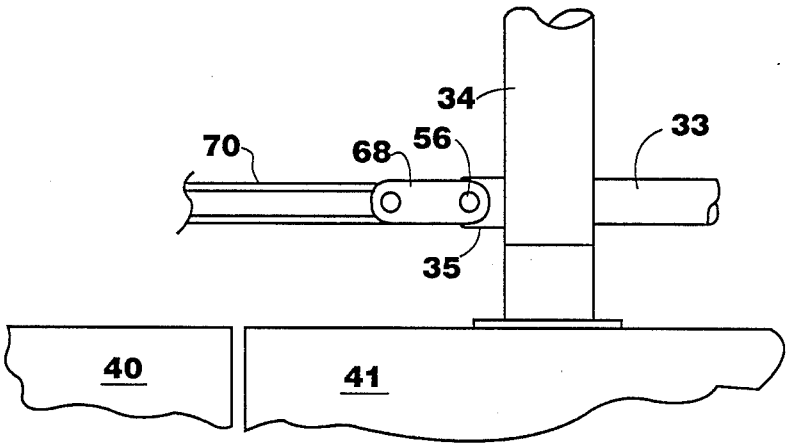
FIG. 3 is another detail fragmentary view of the preferred embodiment of the apparatus of the present invention illustrating the connection formed between the winch cable and the deck package being lifted.
Figure 4:
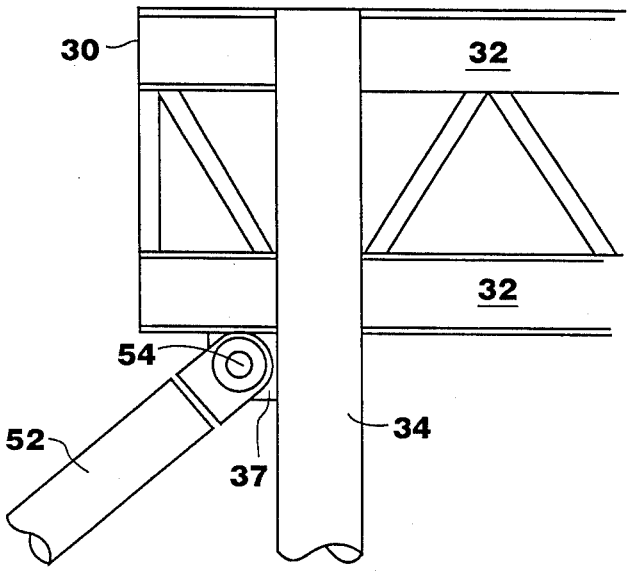
FIG. 4 is another detail fragmentary view of the preferred embodiment of the apparatus of the present invention illustrating the pin connection formed between the package being lifted and one of the truss members.
Figure 5:
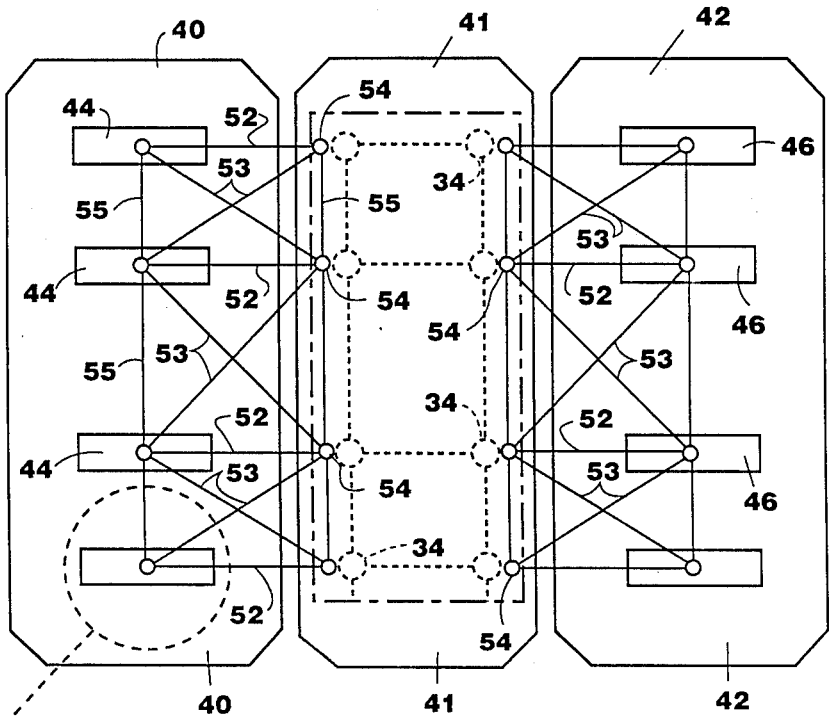
FIG. 5 is a top view of the preferred embodiment of the apparatus of the present invention.
Figure 6:
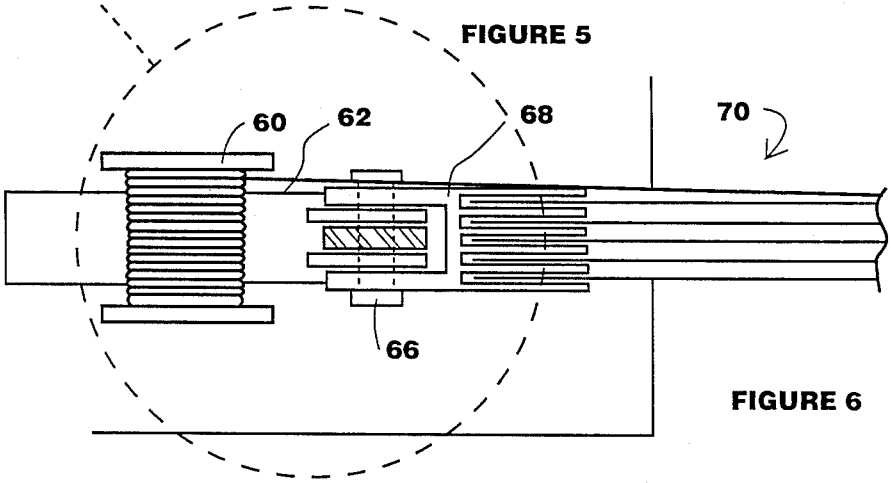
FIG. 6 a detailed fragmentary view of the winch and winch cable portions of the preferred embodiment of the apparatus of the present invention.

In FIG. 3, the second of two multi-sheave block assemblies 68 is shown as forming a connection with the multiple winds 70 of cable 62. The deck leg 34 has a padeye or the like 35 positioned at the connection between deck leg 34 and fixed tension member 33 of deck package 30. As shown in FIG. 5, several pedestals 44, 46 can be provided at spaced intervals along the length of lift barges 40, 42. Each pedestal 44, 46 includes the assembly of FIG. 2 with winch 60, padeye assembly 64, pin 66, compression member 52, multi-sheave block 68 and multi-wind winch line 70. A number of lower connections 56 (FIG. 3) and upper connections 54 (FIG. 4) are preferably provided corresponding to each pedestal 44, 46.

A transport barge 41 would normally be used to carry deck platform 30 to an offshore location where it is to be placed upon jacket 12. However, it should be understood that the apparatus could be transported without the use of transport barge 41 if the compression diagonal truss members 52 and variable length truss members 58 are connected as shown in FIG. 11 and prior to disembarking.

Upper connection 54 is made with padeye 37 which is adjacent deck leg 34 and horizontal member 32. A pinned connection 54 is formed between compression diagonal truss member 52 and the member 37 so that diagonal truss member 52 can rotate with respect to deck package 30.

FIG. 5 illustrates a plan view of the preferred embodiment of the apparatus of the present invention which shows that multiple members 52 in combination with diagonal members 53 and longitudinal members 55 define a laterally extending rigid truss portion. Thus the members 52, 53, 55 in combination with the truss member 58 define a three dimensional truss which is connected at one end portion at pinned connection 50 to barges 40, 42 and at its other end portion the three dimensional truss is connected to upper connection member 54 and lower connection 56.

Figure 7:
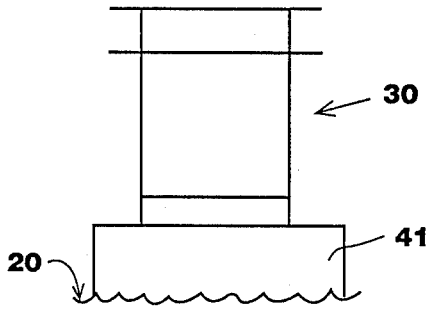
Figure 8:
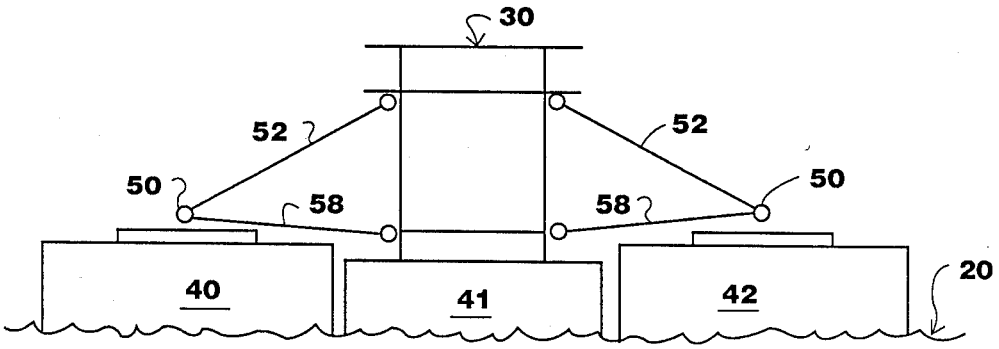
FIGS. 8–11 are sequential views illustrating the method of the present invention.
Figure 9:
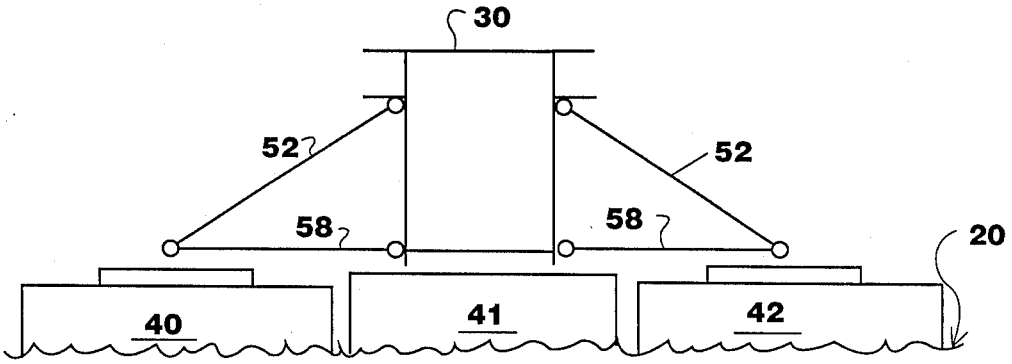

FIGS. 7–11 illustrate the sequential steps in placement of an offshore deck structure using the method of the present invention. In FIG. 7, there can be seen the deck platform 30 mounted on a transport barge 41. In FIG. 8, connections had been formed between the compression diagonal truss members 52 and the variable length truss member 58 with deck package 30. In the position shown in FIG. 8, the truss member 58, preferably a multi-line winch line 70 has been relaxed and extended. In FIG. 9, the winch lines 70 have been shortened, placing tension in the variable length truss member 58 so that the deck package 30 can be lifted slightly, thus allowing transport barge 41 to be removed. In FIG. 10, the transport barge 41 has been removed and the deck package 30 has been aligned above jacket 12. In FIG. 11, the variable length truss members 58 have been extended allowing deck package 30 to lower into its position upon jacket 12.

The use of two lift barges 40, 42 allows each barge 40, 42 to move laterally with respect to each other and with respect to deck package 30 during a lift. Alternately, a single U-shaped barge (not shown) could be used with a system of rollers or the like allowing movement of Bases 44, 46 with respect to each other for effecting the necessary movement as the dimension and/or position of truss members 58 and 52 change.

Winches 60 could be, for example the same high capacity type winches used on derrick barges or the like. Similarly, the multi-sheave block assembly 68 could be similar in design and construction to those multi-sheave blocks used with derrick barges having high load carrying capability. Such winches and multi-sheave block assemblies are commercially available.

Because many varying and different embodiments may be made within the scope of the inventive concept herein taught, and because many modifications may be made in the embodiment of the law, it is to be understood that the details herein are to be interpreted as illustrative and not in a limiting sense.

What is claimed as the invention is:

1. A method for the offshore installation of multi-ton prefabricated deck package on a jacket foundation, comprising the steps of:

a. transporting the prefabricated deck package to the site of the jacket base on a first transport barge;

b. attaching a triangular truss-like lifting assembly to the deck package at multiple positions on the deck package that are at least on generally opposite sides of the deck package, and at upper and lower positions on the deck package respectively and at vertices of the triangular truss-like lifting assembly, the triangular truss-like lifting assembly including at least three chords, including a horizontal chord normally in tension during the lifting process which has a variable length and a diagonally extending chord normally in compression during the lifting process;

c. structurally supporting the triangular truss-like lifting assembly with one or more lift barges;

d. removing the transport barge as a support for the deck package so that the deck is supported by the triangular truss-like lifting assembly and lift barges, with the deck package froming a load carrying portion of the triangular truss-like lifting assembly;

e. alinging the deck package with the jacket so that the deck package can be placed on the jacket; and f. lowering the deck package upon the jacket by changing the length of the horizontal chord of each triangular truss-like lifting assembly.

2. The method of claim 1, wherein the deck package is placed on the jacket foundation by lengthening the variable length lifting assembly movable portion.

3. The method of claim 1, wherein the truss-like lifting assembly lowers the deck package during placement of the deck package on the jacket base.

4. The method of claim 1, wherein in step "f," the variable length movable portion of the lifting assembly includes a winch that is wound with a lift cable which winds/unwinds to change the length of the cable.

5. The method of claim 1, wherein in step "c" the lift barges are floating barges.

6. The method of claim 1, wherein in step "b" one portion of the lifting assembly is a compression carrying diagonal member that is pinned at one end to the deck package.

7. The method of claim 6, wherein each lift barge has a winch structurally mounted thereon and the lower connection formed with the package deck includes a flexible cable extending between the winch and the deck package.

8. The method of claim 7, wherein the truss-like lifting assembly includes a non-extensible diagonal member connecting the lift barge and the upper attachment position of the deck with pinned connection.

9. The method of claim 1 wherein in step "a" the truss-like lifting assembly is attached to the deck package before transportation of the deck package to the site of the jacket base.

10. A lifting apparatus for placing a multi-ton deck package on an offshore jacket foundation, comprising:

a. barge means defining a base that can support a large multi-ton load;

b. truss means supported by the barge means about the periphery of the deck package for forming a load transfer between the barge means and the deck package to be placed;

c. upper and lower connection means for forming attachments of the truss means to the deck package at upper and lower respective elevational positions; and d. means for lowering the combination of the truss means and the supported deck package with respect to the jacket foundation such as during placement of the deck package on the jacket foundation.

11. The apparatus of claim 10 wherein the truss means is a variable dimension truss means that includes at least one truss member of variable length.

12. The apparatus of claim 10 wherein the barge means includes two barge surfaces spaced generally on opposite sides of the deck package being lifted during placement of the deck package on the jacket foundation.

13. The apparatus of claim 1 wherein the variable dimension truss means includes two truss members which are pinned at a common location but which are angularly disposed with respect to each other.

14. The apparatus of claim 13 wherein the two truss members are pinned to the barge means.

15. The apparatus of claim 11 wherein the truss member of variable length includes a winch operated cable.

16. The apparatus of claim 10 wherein the upper connection means is a pinned connection formed between an upper position on the deck package and the truss means.

17. The apparatus of claim 11 wherein the variable dimension truss means includes a winch operating a cable.

18. The apparatus of claim 17 wherein the variable dimension truss means is a three dimensional truss.

19. The apparatus of claim 18 wherein the three dimensional truss extends along the length of the barge means.

20. The apparatus of claim 11 wherein the barge means includes a pair of separate barges that can be positioned on opposite sides of the deck package during placement of the deck package on the jacket and the variable dimension truss means includes a laterally extending rigid truss member on each barge that is pinned at a connection to the barge and at a connection to the deck package.

21. The apparatus of claim 20 wherein the variable length member includes multiple winch and cable assemblies spaced along the upper deck surface of each barge.

22. The apparatus of claim 20 wherein the variable length member of the truss includes a winch and cable connecting the two barges directly.

23. The apparatus of claim 11 wherein the barge means includes connections between the barge means and the variable dimension truss means which can move apart or together when the deck package is lowered or raised.

* * * * *